US011268333B2

(12) United States Patent
Foley, Jr.

(10) Patent No.: US 11,268,333 B2
(45) Date of Patent: Mar. 8, 2022

(54) SAFETY HANDLE APPARATUS

(71) Applicant: Foley Patents, LLC, Lafayette, LA (US)

(72) Inventor: Lawrence E. Foley, Jr., Lafayette, LA (US)

(73) Assignee: FOLEY PATENTS, LLC, Abbeville, LA (US)

( * ) Notice: Subject to any disclaimer, the term of this patent is extended or adjusted under 35 U.S.C. 154(b) by 410 days.

(21) Appl. No.: 16/220,754

(22) Filed: Dec. 14, 2018

(65) Prior Publication Data

US 2019/0186217 A1 Jun. 20, 2019

Related U.S. Application Data

(60) Provisional application No. 62/599,084, filed on Dec. 15, 2017.

(51) Int. Cl.
*E21B 19/16* (2006.01)
*B25G 1/10* (2006.01)
*B25B 5/00* (2006.01)

(52) U.S. Cl.
CPC ..... *E21B 19/161* (2013.01); *B25B 5/00* (2013.01); *B25G 1/102* (2013.01)

(58) Field of Classification Search
CPC ..... E21B 19/161
USPC ..... 81/177.3
See application file for complete search history.

(56) References Cited

U.S. PATENT DOCUMENTS 4,895,044 A * 1/1990 Ekins ..... B62K 21/26 16/421
6,119,558 A * 9/2000 Foley, Jr. ..... E21B 19/161 81/90.5
6,327,940 B1 * 12/2001 Price ..... E21B 19/161 81/177.1
6,571,667 B2 * 6/2003 Price ..... E21B 19/161 81/57.15
10,458,205 B2 * 10/2019 Holtby ..... E21B 19/161
2003/0013393 A1 * 1/2003 George ..... E21B 19/16 451/442
2008/0276430 A1 * 11/2008 Sharpe ..... A45F 5/1026 16/430

* cited by examiner

*Primary Examiner* — David B. Thomas
*Assistant Examiner* — Jonathan G Santiago Martinez
(74) *Attorney, Agent, or Firm* — Ted M. Anthony

(57) ABSTRACT

A safety handle for use with conventional pipe tongs. The safety handle has a hand grip, as well as upper and lower flange members. The flange members beneficially define a recess for receiving (and protecting) a user's thumb. At least one attachment cavity is provided for receiving, and securely attaching the safety handle to, a tong jaw member.

10 Claims, 4 Drawing Sheets

SAFETY HANDLE APPARATUS

CROSS REFERENCES TO RELATED APPLICATIONS

This application claims priority of U.S. provisional patent application Ser. No. 62/599,084, filed Dec. 15, 2017, incorporated by reference herein.

STATEMENTS AS TO THE RIGHTS TO THE INVENTION MADE UNDER FEDERALLY SPONSORED RESEARCH AND DEVELOPMENT

None

BACKGROUND OF THE PRESENT INVENTION

1. Field of the Invention

The present invention pertains to a safety handle apparatus that can be disposed about a periphery of a variety of different heavy equipment to protect an operator's hand(s) from injury. More particularly, the present invention pertains to a safety handle apparatus that can be mounted onto a set of manual, hydraulic, or pneumatic pipe tongs ("tongs") that are used in the oil well drilling industry. More particularly still, the present invention pertains to a safety handle apparatus for use with tongs wherein a shaped recess is provided in an upper surface of said handle apparatus; a user's thumb can be received within said recess and protected from contact as said tongs are lifted into position.

2. Description of Related Art

Tongs are well known in the oil and gas well drilling industry. Typically, said tongs are used to grip sections of pipe, or other tubular goods, and to apply torque to tighten ("make-up") or to loosen ("break out") threaded connections between individual sections of pipe. The assembly of individual sections or joints of pipe—attached in end-to-end relationship in order to form a single continuous length of pipe—is commonly referred to as a "pipe string" or "string."

As drilling progresses, additional joints of pipe are frequently added to the uppermost end of a pipe string; this is typically done by mating the lower threaded connection of a joint that is to be added to said string with the upper threaded connection of the top or upper most member of said string. Similarly, it is frequently necessary and/or desirable to remove pipe segments from a string, either as individual sections or as a plurality of joints (commonly referred to as a "stand"). In such cases, the threaded connection of the uppermost pipe joint/stand is loosened and disengaged from the string.

Although many different types and configurations of pipe can be used during downhole well operations, drill pipe is frequently used for a variety of different applications. Each joint or section of conventional drill pipe typically has an enlarged diameter ("tool joint") disposed at each end to accommodate a threaded connection member at said end. A tool joint is relatively short in the vertical dimension; when gripped by a tong, said tool joint is often barely longer than the thickness (vertical height) of said tong.

Manual tongs generally comprise an assembly of hinged jaw members pivotally disposed at a first end of a lever member. Said jaw assembly typically comprises a latching means; the jaw assembly may be opened, moved into position about the pipe, and then latched securely in gripping relationship around the pipe. A cable attached to the opposite (second) end of the lever member from the jaw assembly can apply a force to the lever member that is relatively perpendicular to said lever. In this manner, the force can be transmitted through the tong to the pipe, and the tong can be used to apply torque force to the pipe.

Typically, tongs are used in pairs, one being a mirror image of the other. A first tong is generally latched in gripping relationship about a tool joint of an upper connection (of an upper pipe section) by a first operator. Said first tong is used to apply the required torque in order to rotate and "break out" the upper joint. Meanwhile, a second tong is latched in gripping relationship about a tool joint of a lower connection (of a lower pipe section) by a second operator. Said second tong prevents the string from rotating—that is, the second tong counters the torque applied by the first tong.

The distance from a rig floor to a threaded connection that is to be made-up or broken-out can vary considerably from one connection to the next. As such, users must continually move tongs vertically (up and down, depending on the position of a threaded connection) in order to position the tongs about the tool joints. In order to facilitate this movement, the tongs—which can be robust and substantial—are suspended from a cable that passes over a sheave mounted at an elevated location. A counterweight attached to the opposite end of the cable balances the weight of the tongs and allows the tongs to be moved vertically relative to a threaded pipe connection.

Typically, if a user is lifting a tong from a relatively low position in proximity to the rig floor, said user often instinctively places his or her thumb above the handle of the tong. If said tong is a lower tong that is moved in a relatively upward direction toward an upper tong, said user's thumb is exposed to being smashed between the two tongs. Moreover, the mass of the tongs frequently imparts significant momentum, making it difficult for a user to precisely stop the movement of tongs at a desired position. As a result, a user's hand can be smashed by side impact between a tong and the pipe.

It is to be observed that in order to protect a user's hand from injury, a user's thumb should be protected from top impact. Similarly, a user's hand (and, in particular, the knuckles and fingers thereof) should also be protected from side impact. Such protection should beneficially be provided in connection with both manual and powered tong assemblies.

Conventional safety handles generally suffer from a number of disadvantages including, without limitation, the following:

- a tong is often lower to a rig floor than a user's waist. As a result, when a user grasps a tong handle, a flange of said handle that is large enough to protect a user's knuckles from side impact will also interfere with the user's ability to bend the wrist;
- conversely, if a round flange of a safety handle is small enough to avoid interfering with a user's wrist as described above, a user's knuckles are not sufficiently protected from a side impact;
- alternatively, a user may grasp a handle by placing his or her thumb above the flange, thereby subjecting the thumb to impact from above;
- because tongs are typically used in sets of two, said tongs are frequently close together. Conventional safety handles significantly increase the overall vertical dimension of a tong and may be damaged as two tongs move next to each other;

conventional safety handles having flanges require considerable thickness of said flanges, thereby reducing the distance between the flanges to a dimension that is too small for a typical gloved hand to grasp said handle;

conventional safety handles generally must be of a greater vertical dimension than the height of a tong, thereby causing safety handles of a first tong to interfere with the safety handles of a second tong as the two tongs are moved in close proximity.

Because of the fast pace and repetition of latching and unlatching of tongs on a drilling rig, tong users can have a tendency to forget about safety while in operation, and can often revert to grabbing the tong in the most natural and convenient manner. Instead of forcing the tong operator to grab the tong in an unnatural manner as required by conventional safety handles (such as, for example, requiring that the operator not put his thumb above the tong) the present invention provides for a safer operation and allows the tong operator to grab the tong in a natural position.

Thus, there is a need for a tong safety handle that overcomes the disadvantages of conventional tong safety handles and provides for significantly greater protection to a tong user.

SUMMARY OF THE INVENTION

The present invention comprises a safety handle that can be operationally attached to a conventional tong. The safety handle of the present invention permits safer operation of a tong by allowing a tong operator to grab said tong in a natural position, while also protecting a user's hand. Thus, the safety handle of the present invention overcomes the disadvantages of conventional safety handles and provides for significantly greater protection to a tong user.

In a preferred embodiment, the present invention comprises a safety handle apparatus for use with manual, hydraulic, or pneumatic pipe tongs used in the oil and gas industry. Said safety handle apparatus of the present invention comprises a hand grip member having a first end and a second end. In a preferred embodiment, said hand grip member is substantially cylindrical in shape. Further, said hand grip member can embody an ergonomic design to conform to a human hand, wherein said grip member has a larger diameter near its center point than at its first and second ends.

A flange member is beneficially disposed at both said first and second ends of said hand grip member. Each of said flange members comprises a hand protection lobe that extends in a radially outward direction from said hand grip member and defines a radially protruding outer surface. Said protection lobe protects and/or shields an operator's fingers and knuckles while said operator is grasping said hand grip member, particularly in the event that said outer surface contacts another object. Said hand protection lobe can comprise a substantially rounded, straight, noncircular, or irregularly shaped configuration.

A thumb protection recess is beneficially formed in the outer end surface of said flange members, generally above said hand grip member. Said thumb protection recess provides a recessed area for receiving an operator's thumb during use. While the protection lobe of each flange member protects an operator's hand (and particularly fingers and knuckles) during use, said thumb protection recess protects a user's thumb during use, particularly when the upper surface of said flange member contacts another object. The thumb protection recess can comprise any shape or configuration that will allow a thumb to be comfortably placed within said thumb protection recess when the hand grip member is grasped by an operator of the tong.

In a preferred embodiment, each flange member further comprises at least one attachment cavity or recess formed in a portion of said flange member. Attachment members that protrude from a body of a conventional tong jaw can be received within said at least one attachment cavity within each flange member. Thereafter, an attachment pin or other similar attachment means can be received within a bore in said safety handle apparatus and tong attachment members in order to secure said safety handle to said tong jaw.

The safety handle apparatus of the present invention is substantially symmetrical, while said flange members are oriented substantially perpendicular to a centerline axis of said hand grip member. Such symmetry is advantageous in order to use said tongs in an upside down position, which sometimes occurs on a conventional drilling rig. Additionally, this symmetry is further advantageous because the same or similar handle configuration may be used on opposite sides of the tong.

It is to be observed that the dimension between the medial surfaces of opposing flange members—that is, the gap between said surfaces or, put another way, the length of said hand grip member—should be sufficient to receive an average hand size to comfortably grasp said hand grip member. By way of illustration, but not limitation, this dimension can range from approximately four (4) inches to approximately seven (7) inches. In addition, said hand grip member can comprise any shape or configuration that can allow for said hand grip member to be comfortably grasped by an average hand size.

In a preferred embodiment, each flange member comprises an attachment surface that is disposed in a substantially parallel orientation to a mating surface of a tong jaw. It is to be observed that the dimension from the center axis of the hand grip member to said attachment surface should be sufficient to allow an average hand size to pass between the hand grip member and the mating surface of the tong jaw when the safety handle is assembled onto the tong jaw. Although different dimensions would suffice, dimension can typically range from approximately one (1) inch to approximately two (2) inches.

In a preferred embodiment, when the present invention is in operation, said safety handle apparatus is employed in a similar manner to that of a conventional pipe tong handle. A tong operator can grasp a hand grip member of the present invention, and can raise or lower the tong to a proper working height. The operator can then apply desired force to said safety handle in order to move said tong into position and to latch said tong about a pipe or other tubular. Once a latch of a tong is engaged about a tubular, the operator can pull on said safety handle to cause said tong to grip or tighten upon the tubular. After a threaded connection is made-up or broken out, the operator can grasp the safety handle again in a similar manner in order to disengage the tong from the tubular, unlatch the tong, and/or move the tong away from said pipe or tubular.

Additionally, the present invention comprises a variety of objects and advantages, such as, for example providing a tong safety handle that: (i) automatically causes a tong operator's hand to fall into a safe and protected position as the handle is grabbed, even if the tong operator is rushed or distracted; (ii) has upper and lower flange members that adequately protect an operator's knuckles from side impact;

and (iii) includes a relief area or recess for receiving an operator's thumb in order to protect said thumb from impact from above.

BRIEF DESCRIPTION OF THE DRAWINGS

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

While the present invention will be described with reference to preferred embodiments, it will be understood by those skilled in the art that various changes may be made and equivalents may be substituted for elements thereof without departing from the scope of the present invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof).

Figure 1:
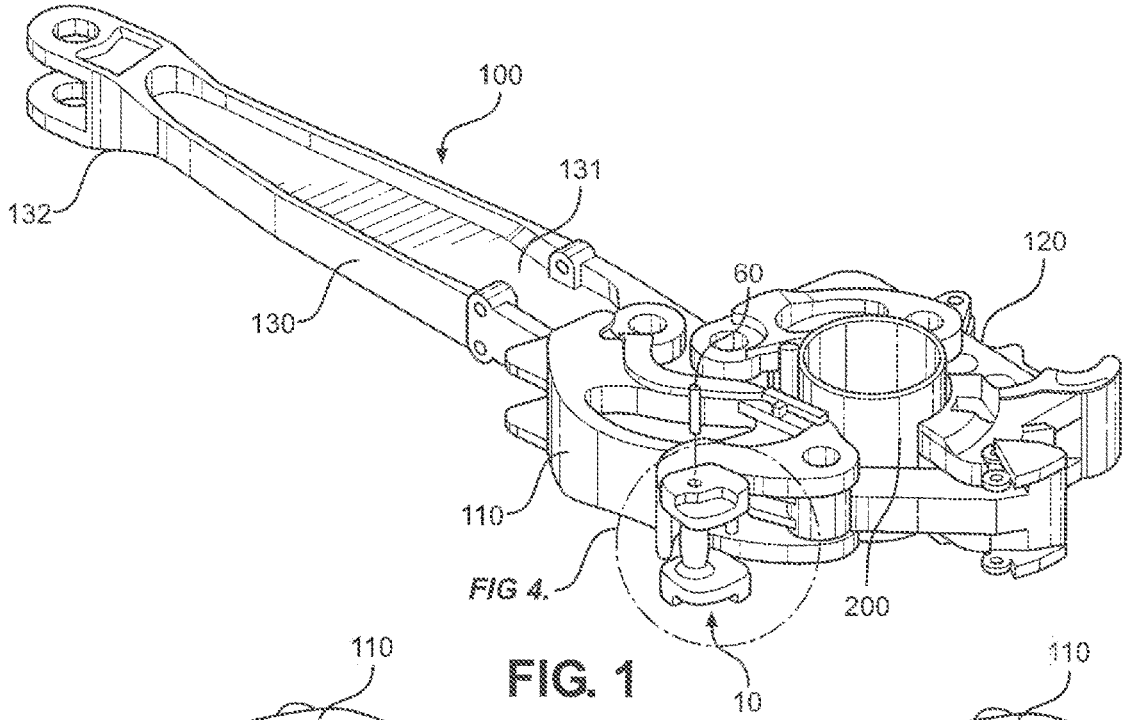
FIG. 1 depicts a side perspective view of a preferred embodiment of a safety handle apparatus of the present invention installed on a conventional manual pipe tong assembly.

Referring to the drawings, FIG. 1 depicts a side perspective view of a preferred embodiment of a safety handle apparatus 10 of the present invention installed on a manual pipe tong 100. Said manual pipe tong 100 generally comprises a jaw assembly of hingedly attached jaw members 110 and 120 that are pivotally disposed at a first end 131 of a lever member 130. Said jaw members 110 and 120 cooperate (together with accessory fittings) to define a latching mechanism well known to those having skill in the art; said latching mechanism can be used to selectively and securely grip the outer surface of pipe section 200. A cable or other flexible member can be attached to outer second end 132 of lever member 130 in order to apply a force to lever member 130. In this manner, tong 100 can be used to transmit torque force to pipe section 200.

Figure 2:
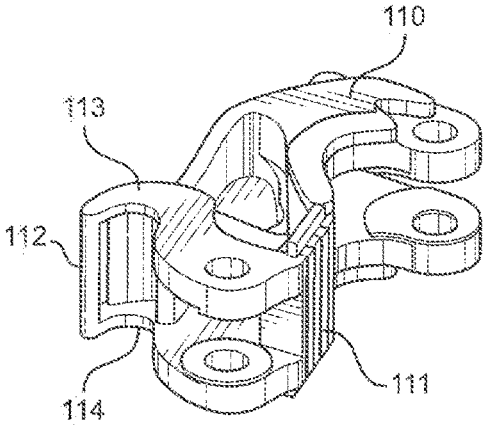
FIG. 2 depicts a side perspective view of a prior art pipe tong member having a conventional metal handle.

FIG. 2 depicts a side perspective view of a prior art tong jaw member 110 having gripping dies 111. It is to be observed that prior art tong jaw member 110 is depicted in FIG. 2 as being detached from a complete pipe tong (such as, for example, pipe tong 100 depicted in FIG. 1) for simplicity and ease of reference. However, during use, said tong jaw member 110 is typically operationally attached to other components to form a complete pipe tong device. As depicted in FIG. 2, said tong jaw member 110 further comprises handle 112 attached to said tong jaw member 110 via upper handle mounting member 113 and lower handle mounting member 114.

Although other materials can be utilized without departing from the scope of the present invention, in most cases, tong jaw member 110—including, without limitation, handle 112, upper handle mounting member 113 and lower handle mounting member 114—is constructed of metal material. As depicted in FIG. 2, handle 112 comprises a substantially cylindrical member that is configured to be grasped by tong user's hand.

Figure 3:
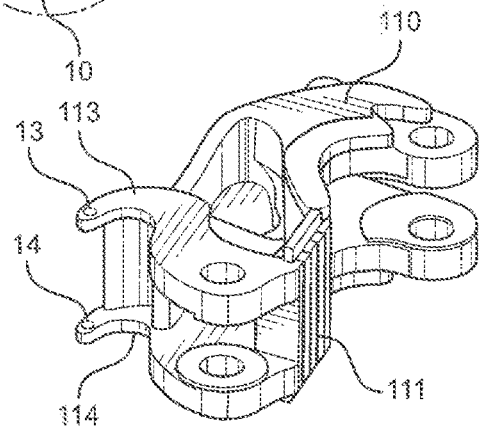
FIG. 3 depicts a side perspective view of a prior art pipe tong member having a conventional metal handle removed, such as in preparation for installation of the tong safety handle of the present invention.

FIG. 3 depicts a side perspective view of a prior art pipe tong member 100 having a conventional handle removed, such as in preparation for installation of the tong safety handle of the present invention. As depicted in FIG. 3, a handle (such as handle 112 depicted in FIG. 1) has been removed from tong member 110—although any number of means can be used, said handle 112 can be removed by sawing or cutting the handle from tong member 110. Further, as depicted in FIG. 3, upper handle mounting member 113 and lower handle mounting member 114 extend from said tong member 110; said upper handle mounting member 113 and lower handle mounting member 114 are disposed in substantially parallel orientation relative to each other.

Still referring to FIG. 3, aperture 13 can be drilled or otherwise formed to extend through upper handle mounting member 113. Similarly, aperture 14 can be drilled or otherwise formed to extend through lower handle mounting member 114. In a preferred embodiment, said apertures 13 and 14 are aligned with each other, such that a substantially straight elongate pin or bolt (such as pin 60 depicted in FIG. 1) can be simultaneously received within both of said aligned apertures 13 and 14.

Figure 4:
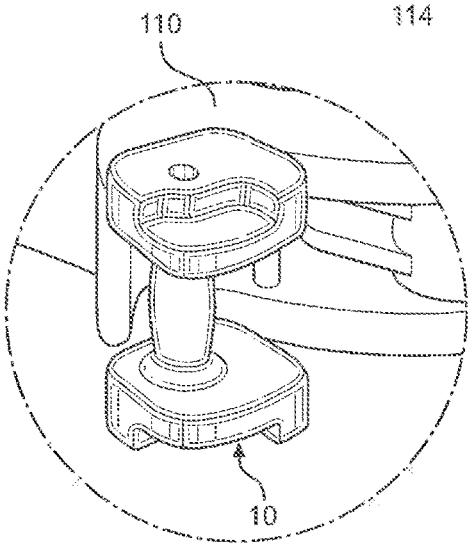
FIG. 4 depicts a detailed view of the highlighted area of FIG. 1.

FIG. 4 depicts a detailed view of the highlighted area of FIG. 1, including safety handle apparatus 10 of the present invention installed on tong member 110. It is to be observed that safety handle apparatus 10 is installed on tong member 110 following the removal of a conventional handle (such as handle 112 shown in FIG. 2); thus, safety handle 10 is typically installed on tong apparatus 110 in the embodiment of said tong member 110 depicted in FIG. 3.

Figure 5:
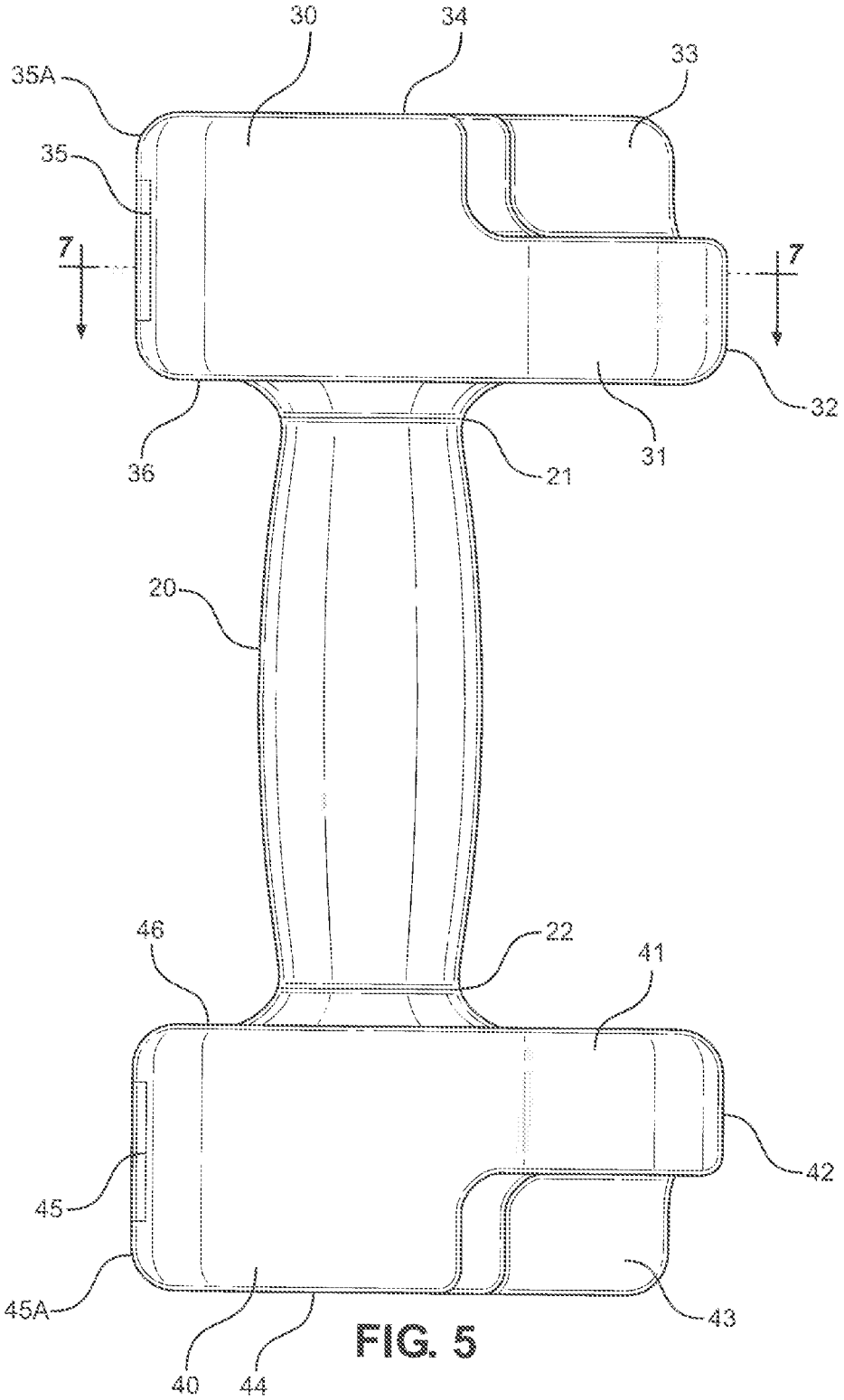
FIG. 5 depicts a side view of a preferred embodiment of a safety handle apparatus of the present invention.

FIG. 5 depicts a side view of a preferred embodiment of a safety handle apparatus 10 of the present invention. Referring to FIG. 5, safety handle apparatus 10 generally comprises hand grip member 20 having a first end 21 and a second end 22. In a preferred embodiment, said hand grip member 20 is substantially cylindrical in shape. Further, said hand grip member 20 can embody an ergonomic design to comfortably conform to the shape of a human hand when engaged in a gripping motion, wherein said grip member 20 has substantially convex outer surfaces and a larger diameter near its longitudinal center or mid-point than at said first end 21 and second end 22. Put another way, said grip member 20 is beneficially thicker near its central region than at first end 21 and second end 22.

First flange member 30 is disposed at said first end 21 of hand grip 20, while second flange member 40 is disposed at said second end 22 of hand grip 20. Flange member 30 further comprises a hand protection lobe 31 that extends in radially outward direction from said hand grip member 20 and defines a radially protruding outer surface 32. Similarly, flange member 40 further comprises a hand protection lobe 41 that extends in radially outward direction from said hand grip member 20 and defines a radially protruding outer surface 42.

Hand protection lobes 31 and 41 protect and/or shield a user's hand, including fingers and knuckles, while said user is grasping said hand grip member 20, particularly in the event that said outer surfaces 32 and/or 42 contact another object. Although said hand protection lobes 32 and 42 are depicted in a preferred embodiment as having a generally curved or rounded shape, it is to be observed that said protection lobes 32 and/or 42 can alternatively comprise a substantially straight, noncircular, or irregularly shaped configuration, so long as said lobe(s) extend a sufficient distance outward from handle member 20 to protect a user's hand, fingers and knuckles when disposed around handle member 20.

Thumb protection recess 33 is beneficially formed in the outer (typically upper) surface of said flange member 30, generally above and laterally offset from said hand grip member 20. Similarly, thumb protection recess 43 is beneficially formed in the outer (typically lower) surface of said flange member 40, generally below and laterally offset from said hand grip member 20. Said thumb protection recess 33 (and 43 when safety handle apparatus 20 is installed in an inverted position) provides a recessed area for receiving a user's thumb during use. While hand protection lobe 31 of flange member 30 and hand protection lobe 41 of flange member 40 beneficially protect a user's fingers and knuckles during use, said thumb protection recess 33 (and 43 when safety handle apparatus 20 is installed in an inverted position) protects said user's thumb during use. Because a user's thumb can be received within said recess 33, said thumb does not extend or protrude above upper surface 34 of flange member; as a result, a user's thumb is not impacted in the event that said upper surface 34 contacts another object.

It is to be observed that the dimension between medial surface 36 of flange 30 and opposing medial surface 46 of flange member 40 should be sufficient to receive an average hand size to comfortably grasp said hand grip member 20. By way of illustration, but not limitation, in a preferred embodiment this dimension will range from approximately four (4) inches to approximately seven (7) inches. Further, it is to be observed that the dimension from the center axis of hand grip member 20 to outer surface 35A of flange 30, as well as to outer surface 45A of flange 40, should be sufficient to allow an average hand size to pass between the hand grip member and the mating surface of the tong jaw when the safety handle is assembled onto the tong jaw. In a preferred embodiment, this dimension can range from approximately one (1) inch to approximately two (2) inches.

Figure 6:
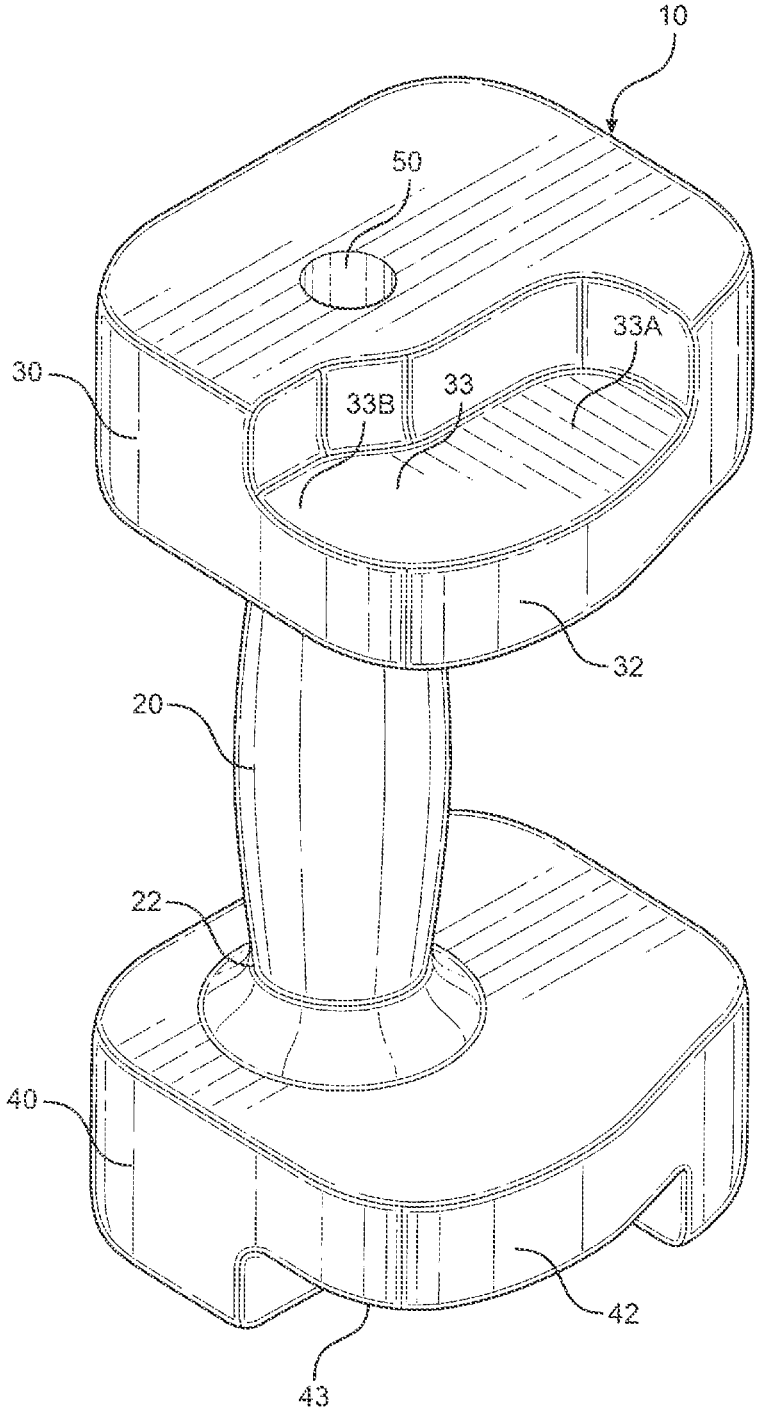
FIG. 6 depicts a side perspective view of a preferred embodiment of a safety handle apparatus of the present invention.

FIG. 6 depicts a side perspective view of a preferred embodiment of a safety handle apparatus 10 of the present invention. Safety handle apparatus 10 generally comprises hand grip member 20 having a first end 21 (obscured from view in FIG. 6) and a second end 22. In a preferred embodiment, said hand grip member 20 is substantially cylindrical in shape, having substantially convex outer surfaces and a larger diameter near its mid-point than at said first end 21 and second end 22.

First flange member 30 is disposed at said first end 21 of hand grip 20, while second flange member 40 is disposed at said second end 22 of hand grip 20. Flange member 30 further comprises a hand protection lobe defining a radially protruding outer surface 32, while flange member 40 comprises a hand protection lobe defining a radially protruding outer surface 42.

Thumb protection recess 33 is beneficially formed in the outer (typically upper) or top end surface of said flange member 30, generally above and laterally offset from said hand grip member 20. In a preferred embodiment, said thumb recess 33 extends or opens to lateral outer surface 32 of said flange member 30. Similarly, thumb protection recess 43 is beneficially formed in the outer (typically lower) surface of said flange member 40, generally below and laterally offset from said hand grip member 20. Said thumb recess 43 extends or opens to lateral outer surface 42 of said flange member 40. In a preferred embodiment, elongate bore 50 extends through flange member 30, handle member 20 and lower flange 40.

Thumb protection recesses 33 and 43 can each comprise any shape or configuration that will allow a user's thumb to be comfortably received within said thumb protection recess 33 or 43 when hand grip member 20 is grasped by user of a tong. Still referring to FIG. 6, in a preferred embodiment thumb protection recess 33 (and thumb protection recess 43) comprises a relatively wider section 33B at a portion of said recess for receiving a base (generally corresponding to the thenar eminence) of a thumb, and a relatively thinner section 33A at another portion of said recess for receiving the tip of a user's thumb.

Referring back to FIG. 5, flange member 30 further comprises at least one attachment cavity 35 formed in a portion of said flange member 30, while flange member 40 further comprises at least one attachment cavity 45 formed in said flange member 40. Said attachment cavities 35 and 45 extend into said flange members 30 and 40, respectively, and penetrate to a depth beyond handle member 20.

Figure 7:
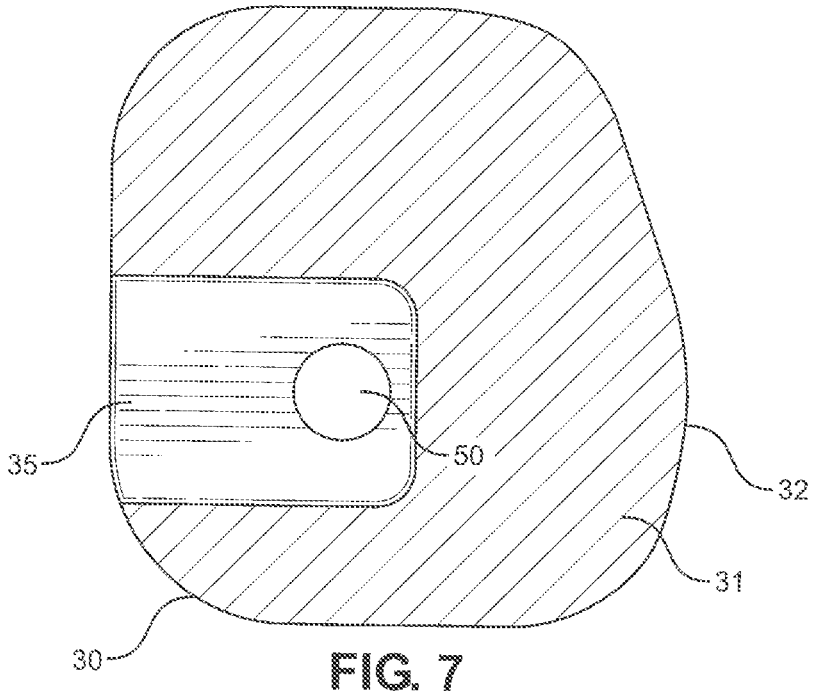
FIG. 7 depicts a sectional view of a preferred embodiment of a safety handle apparatus of the present invention along line 7-7 of FIG. 5.

FIG. 7 depicts a sectional view of a preferred embodiment of a safety handle apparatus 10 of the present invention along line 7-7 of FIG. 5. Flange member 30 further comprises a hand protection lobe 31 defining a radially protruding outer surface 32. Transverse attachment cavity 35 extends into flange 30, extending beyond bore 50 (which extends through handle member 20, not visible in FIG. 7, along the longitudinal axis of said handle member 20). Although not visible in FIG. 7, it is to be observed that transverse attachment cavity 45 similarly extends into flange 40, extending beyond bore 50.

Referring back to FIG. 3, substantially parallel attachment members 113 and 114 that protrude from a body of a conventional tong jaw 110 can be received within said attachment cavities within each flange member. Specifically, parallel attachment member 113 can be received within attachment cavity 35 of flange member 30, while attachment member 114 can be received within attachment cavity 45 of flange member 40. Referring to FIG. 1, after said safety handle 10 is installed on tong jaw member 110, an attachment pin 60 or other similar attachment means can be received within bore 50 (which extends through hand grip member 20), as well as aligned bores 13 and 14 extending through attachment members 113 and 114, respectively, in order to secure said safety handle 10 to said tong jaw 110.

In a preferred embodiment, safety handle apparatus 10 of the present invention is substantially symmetrical, while said flange members 30 and 40 are oriented substantially perpendicular to a centerline longitudinal axis of hand grip member 20. Such symmetry is advantageous in order to use said tongs in an upside down position which is sometimes useful during rig operations. Additionally, this symmetry is further advantageous because the same or similar handle configuration may be used on opposite sides of a conventional tong.

In a preferred embodiment, when the present invention is in operation, said safety handle apparatus is employed in a similar manner to that of a conventional pipe tong handle. A tong operator can grasp a hand grip member of the present invention, and can raise or lower the tong to a proper working height. The operator can then apply desired force to said safety handle in order to move said tong into position and to latch said tong about a pipe or other tubular. Once a latch of a tong is engaged about a tubular, the operator can pulls on said safety handle to cause said tong to tighten upon the tubular. After a threaded connection is made-up or broken out, the operator can grasp the safety handle again in a similar manner in order to disengage the tong from the tubular, unlatch the tong, and/or move the tong away from said pipe or tubular.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A tong safety handle apparatus comprising:

a) a substantially cylindrical grip member having a first end, a second end and a bore extending from said first end to said second end;

b) a first flange member disposed at said first end of said grip member extending radially outward from said grip member and defining a top surface, a bottom surface and a side surface, wherein said first flange member further comprises a recess formed in said top surface for receiving a human thumb and protecting said human thumb from inadvertent impact, and a first lobe that extends radially outward from said side surface of said first flange member;

c) a second flange member disposed at said second end of said grip member and defining a top surface, a bottom surface, and a side surface, and a second lobe that extends radially outward from said side surface of said second flange member.

2. The tong safety handle apparatus of claim 1, wherein said recess has a first section extending radially inward from said side surface of said first flange member, a second section extending radially inward from said side surface of said first flange member, and wherein said first section extends radially inward a greater distance than said second section of said recess.

3. The tong safety handle apparatus of claim 1, wherein said grip member, first flange member and second flange member are constructed of plastic.

4. A tong safety handle apparatus comprising:

a) a substantially cylindrical grip member having a first end, a second end and a bore extending from said first end to said second end;

b) a first flange member disposed at said first end of said grip member extending radially outward from said grip member and defining a top surface, a bottom surface and a side surface, wherein said first flange member further comprises a recess formed in said top surface of said first flange member for receiving a human thumb and protecting said thumb against contact by an object impacting said top surface of said first flange member, and a first lobe that extends radially outward from said side surface of said first flange member;

c) a second flange member disposed at said second end of said grip member and defining a bottom surface, a top surface and a side surface, wherein said top surface of said first flange member and said bottom surface of said second flange member are oriented substantially parallel to each other, and a second lobe that extends radially outward from said side surface of said first flange member.

5. The tong safety handle apparatus of claim 4, wherein said recess has a first section extending radially inward from said side surface of said first flange member, a second section extending radially inward from said side surface of said first flange member, and wherein said first section extends radially inward a greater distance than said second section of said recess.

6. The tong safety handle apparatus of claim 4, wherein said grip member, first flange member and second flange member are constructed of plastic.

7. A method for utilizing a tong on a drilling rig comprising:

a) installing a tong safety handle apparatus on a handle of a tong, wherein said tong safety handle apparatus comprises:

i) a substantially cylindrical grip member having a first end, a second end and a bore extending from said first end to said second end;

ii) a first flange member disposed at said first end of said grip member extending radially outward from said grip member and defining a top surface, a bottom surface and a side surface, wherein said first flange member further comprises a recess formed in said top surface of said first flange member for receiving a human thumb;

iii) a second flange member disposed at said second end of said grip member extending radially outward from said grip member and defining a top surface, a bottom surface and a side surface; and b) gripping said tong safety handle apparatus with a hand, wherein a thumb of said hand is received within said recess and protected against contact by an object impacting said top surface of said first flange member.

8. The method of claim 7, wherein said recess has a first section extending radially inward from said side surface of said first flange member, a second section extending radially inward from said side surface of said first flange member, and wherein said first section extends radially inward a greater distance than said second section of said recess.

9. The method of claim 7, wherein said tong safety apparatus is constructed of plastic.

10. The method of claim 7, wherein said first flange member further comprises a lobe that extends outward from said side surface of said first flange member.

* * * * *